US005416929A

United States Patent [19]

Braunstein

[11] Patent Number: 5,416,929

[45] Date of Patent: May 23, 1995

[54] PANTY HAVING ANTIMICROBIAL TREATED CROTCH FOR KILLING AND INHIBITING THE GROWTH OF YEAST AND BACTERIA

[76] Inventor: Robert A. Braunstein, 22 Trinity Dr., Lumberton, N.C. 28358

[21] Appl. No.: 272,935

[22] Filed: Jul. 11, 1994

Related U.S. Application Data

[63] Continuation-in-part of Ser. No. 205,620, Mar. 3, 1994.

[51] Int. Cl.[6] ..... A41B 9/00; A41B 9/12

[52] U.S. Cl. ..... 2/406; 2/400; 66/176; 66/202; 450/156; 604/360; 604/396

[58] Field of Search ..... 2/400, 401, 402, 403, 2/404, 405, 406, 407, 408, 409, 267, 73, 53, 54, 55, 56, 57, 58; 450/102, 103, 104, 105, 156; 604/360, 396, 385.1; 66/169 R, 175, 176, 177, 202

[56] References Cited

U.S. PATENT DOCUMENTS

| | | | |
|---|---|---|---|
| 2,719,976 | 10/1955 | Sussman | 2/408 |
| 2,898,754 | 8/1959 | Harms | 2/406 |
| 3,312,981 | 4/1967 | McGuire et al. | 2/406 |
| 3,625,029 | 1/1970 | Safrit et al. | 450/104 X |
| 4,155,123 | 5/1979 | Popper | 36/43 |
| 4,244,059 | 1/1981 | Pflaumer | 2/406 X |
| 4,343,853 | 8/1982 | Morrison | 428/233 |
| 4,810,567 | 3/1989 | Calcaterra et al. | 604/360 X |
| 5,118,780 | 6/1992 | Hirai et al. | 528/83 |

*Primary Examiner*—Jeanette E. Chapman
*Attorney, Agent, or Firm*—Rhodes, Coats & Bennett

[57] ABSTRACT

The present invention entails a panty having a crotch area that is specifically designed to kill and inhibit the growth of yeast, bacteria and fungi. In particular, the panty includes a crotch made up of an open knit construction that is formed of both treated and non-treated yarn. The treated yarn is treated with an antimicrobial agent that is capable of killing and inhibiting yeast.

14 Claims, 2 Drawing Sheets

PANTY HAVING ANTIMICROBIAL TREATED CROTCH FOR KILLING AND INHIBITING THE GROWTH OF YEAST AND BACTERIA

This is a continuation-in-part application of U.S. patent application Ser. No. 08/205,620, filed Mar. 3, 1994.

FIELD OF INVENTION

The present invention relates to panties and crotch designs for panties, and more particularly to a panty crotch that includes pretreated antimicrobial yarn that is effective to kill and inhibit the growth of yeast and yeast infections in women.

BACKGROUND OF THE INVENTION

It has been known to provide panties with a crotch that has been treated to control various concerns. For example, U.S. Pat. No. 4,244,059 discloses a panty crotch that comprises a fabric makeup that is designed to absorb odorous molecules from the crotch region. In particular, the crotch panel of this disclosure discloses a soft fabric that has a substantial air permeability with an alkali metal carbonate compound that causes the panty crotch to essentially absorb certain odors in and around the crotch region.

U.S. Pat. No. 4,731,063 discloses a disposable insert device that can be placed within an undergarment in the crotch region that is effective to inhibit bacterial growth and which is claimed to suppress and reduce undesirable body odors in the crotch and genital area.

U.S. Pat. No. 5,152,014 discloses a liner for a woman's body undergarment that is formed of a hydrophobic fiber having an irregular outer surface which transports or "wicks" moisture away from the body. This patent appreciates that by reducing the moisture content in the crotch region of a woman's panty that such may help reduce the generation of yeast infections.

It is further appreciated that yeast infections among women are both common and certainly aggravating and discomforting. Presently, there is little that a woman can actually do to prevent yeast infections before they occur. Usually, yeast infections are treated only after they are present and the unpleasant accompanying systems have become manifested.

There is and continues to be a need to treat or more particularly to kill and inhibit yeast-causing bacteria before the bacteria has an opportunity to give rise to an internal yeast infection.

SUMMARY AND OBJECTS OF THE INVENTION

The present invention entails a panty having a crotch that has been particularly treated with an antimicrobial agent that is specifically designed to kill and inhibit yeast found in the crotch area of a woman's panty. In particular, the panty of the present invention includes an open knit crotch area or panel that is made up at least in part of treated yarns. The yarns before being fabricated or knitted have been treated with an antimicrobial agent that is specifically designed or formulated to kill yeast and bacteria.

It is therefore the object of the present invention to provide a panty with a crotch area that has been particularly treated with an antimicrobial agent that is designed to specifically kill or inhibit yeast.

Another object of the present invention is to provide a panty with a treated crotch area of the character referred to above wherein the treated crotch area is comprised of both treated and untreated yarn and wherein the treated yarn which has been pretreated with the antimicrobial agent forms only a part of the total yarn or fabric of the panty crotch.

Another object of the present invention resides in the provision of a panty and a panty crotch area of the character referred to above that is safe and which does not irritate or harm the crotch area of the subject but which is effective to kill and inhibit the growth of yeast.

Other objects and advantages of the present invention will become apparent and obvious from a study of the following description and the accompanying drawings which are merely illustrative of such invention.

DETAILED DESCRIPTION OF THE INVENTION

Figure 1:
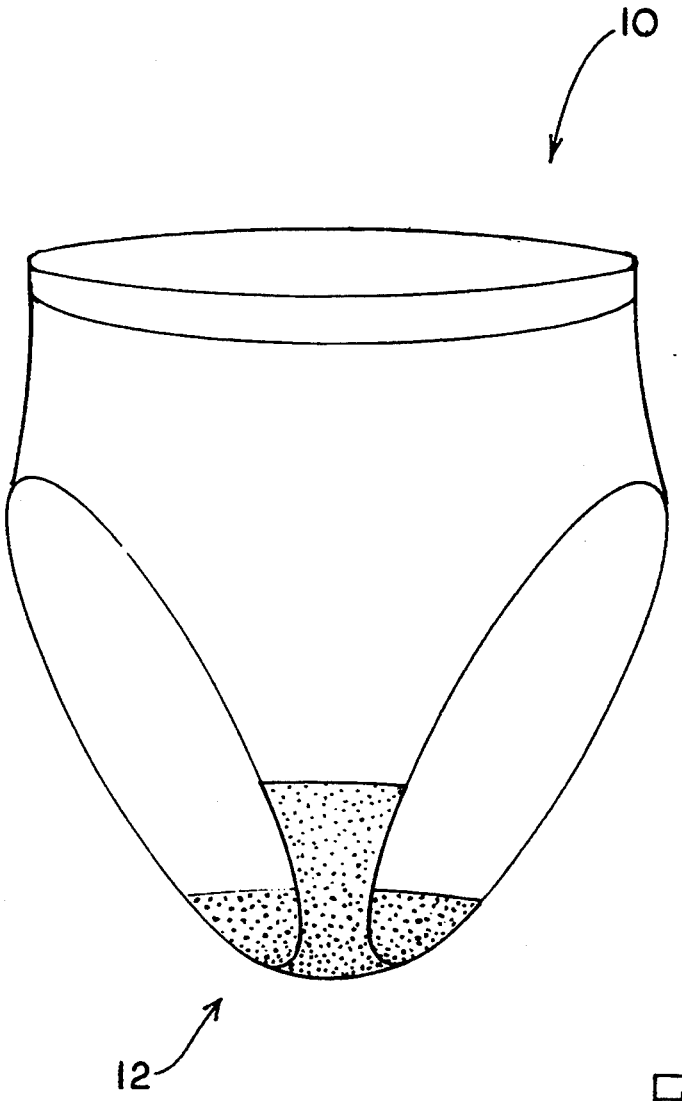
FIG. 1 is a view of a panty having the antimicrobial treated crotch of the present invention incorporated therein.

The present invention entails a panty, indicated generally by the numeral 10, which includes a crotch area 12 that includes in part at least yarn or fibers that have been treated or pretreated to kill and inhibit the growth of yeast that give rise to yeast infections within women.

The basic treated crotch area comprises a panel that is of an open knit construction and which includes, in a preferred embodiment, both treated yarn and non-treated yarn, the non-treated yarn being referred to in the drawings by numeral 14 and the treated yarn being referred to by the numeral 16. The treated yarn is treated with an antimicrobial compound that is designed to kill and inhibit the growth of yeast. In the present case, the antimicrobial agent contemplated for treating the yarn to kill and inhibit yeast is a chlorinated phenoxy antimicrobial compound. In a preferred design the treated yarn is an acetate yarn. It is contemplated that the treated yarn 16 would be subjected to the antimicrobial agent prior to being fabricated into the open knit crotch panel 12. For acetate treated yarn, the chlorinated phenoxy antimicrobial compound is acetone soluble and is introduced into cellulose acetate dope from an acetone solution. The fibers are spun under normal spinning conditions. The treated fibers or yarn that are impregnated or which include the antimicrobial agent (a chlorinated phenoxy antimicrobial compound) is particularly effective against yeast.

Figure 3:
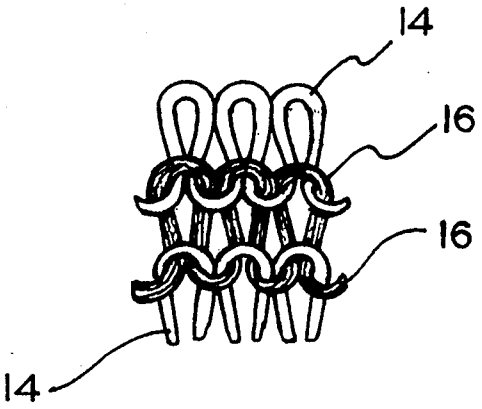
FIG. 3 is a fragmentary schematic illustration of a portion of the treated crotch illustrating the antimicrobial treated yarn being actually knitted in with the non-treated yarn.
Figure 2:
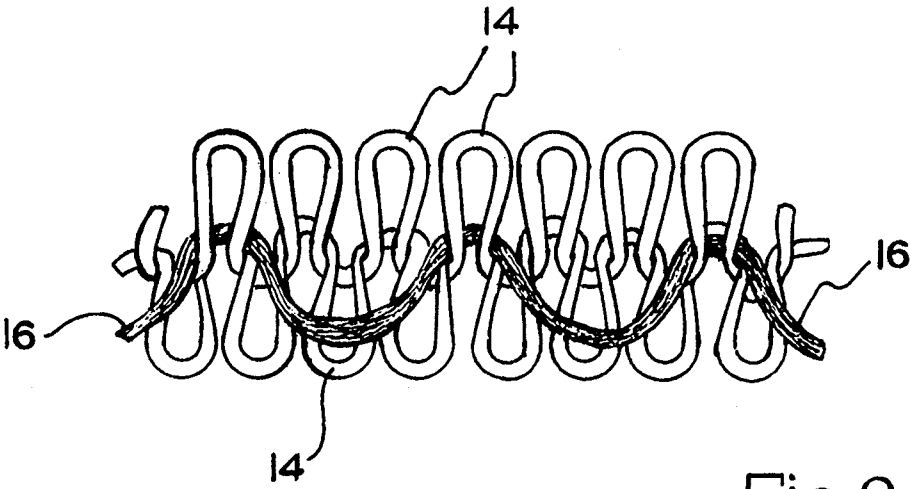
FIG. 2 is a schematic illustration of a portion of the open knit construction of the treated crotch panel with the antimicrobial treated yarn "laid in" with the non-treated knitted yarn.

Now, turning to FIGS. 2 and 3, it is seen that the basic crotch panel 12 is of an open knit construction and the treated yarn 16 can be incorporated with the non-treated yarn in various ways. Two examples are given in the drawings. First, in FIG. 2, the treated yarn 16 is essentially "laid in" in an open knit construction with other non-treated yarns 14. In FIG. 3, the treated yarns 16 are actually incorporated or knitted in with the non-treated yarn 14. The ratio of treated yarn to non-treated yarn can vary but it is contemplated that the treated yarn would comprise approximately 10 to 25% of the total yarn of the treated crotch panel 12. It is appreciated however that the amount or percentage of treated yarn 16 that comprise the crotch panel 12 can vary and in fact under certain conditions and circumstances it may be appropriate for the entire crotch panel 12 to include the treated yarn.

In the embodiment illustrated, the treated crotch panel 12 is simply a single-ply fabric panel that actually forms the crotch of the panty 10. It is appreciated however, that the treated crotch panel 12 could comprise a separate insert or panel that is secured to an untreated base fabric that forms the crotch proper of the panty 10. In other words, the treated crotch panel may comprise the entire base crotch of the panty 10 or can be sewn in or otherwise secured as a separate panel.

Although the treated crotch panel can be comprised of many different types of fibers, for example, synthetics or cotton, it is contemplated that in a preferred design that the open knit fabric comprising the treated crotch 12 will be made mostly of a synthetic fiber such as polyester or polypropylene. Again, the density of the treated crotch fabric 12 can vary but it is contemplated that an appropriate gauge for knitting range would be 14 to 28 "cut" (needles per inch). Preferably, the treated crotch 12 would preferably be of a lightweight fabric with a weight of 4–7 ounces per linear yard (per linear yard meaning 60 inches wide and 1 yard long). The untreated yarn would be a spun yarn and would be approximately 20–36 singles. In a preferred design the untreated yarn would be approximately 30 singles spun yarn. The treated yarn would preferably be a filament-type yarn and would be approximately 50–150 denier.

From the foregoing specification and discussion, it is seen that the present invention presents a panty crotch that is comprised of pretreated yarn wherein the yarn is treated to kill and inhibit the growth of yeast in the crotch area of a woman's panty. The yarn pretreated with the antimicrobial agent is effective to kill and inhibit yeast and is therefore effective to assist in the prevention of yeast infections in women wearing the panty of the present invention. Also, it is appreciated that the antimicrobial agent may kill and inhibit bacteria and fungi also.

In the present disclosure, it has been pointed out that the treated crotch would be particularly useful in killing and inhibiting the growth of yeast-causing bacteria. It should be appreciated by those skilled in the art that the treated yarn and particularly the treated crotch of the present invention may also be useful in killing and inhibiting other type of bacteria and in treating other undesirable conditions.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed is:

1. A panty having an antimicrobial treated crotch wherein the crotch is of an open knit construction and includes pretreated yarn spaced throughout with the pretreated yarn being subjected to a chlorinated phenoxy antimicrobial treatment prior to knitting and wherein the antimicrobial treatment is aimed directly at killing and inhibiting the growth of yeast and bacteria, wherein the crotch is made up of antimicrobial treated and non-treated yarn and wherein both the antimicrobial treated and non-treated yarn are knitted together to form a continuous knit construction made up of both treated and non-treated yarn.

2. The panty of claim 1 wherein the treated crotch is in the form of a crotch panel and wherein the treated crotch panel is secured to a base panty fabric.

3. The panty of claim 1 wherein the treated crotch includes both antimicrobial treated and non-treated yarn and wherein the antimicrobial treated yarn comprises approximately 10 to 25% of the treated panty crotch.

4. The panty of claim 3 wherein the yarn that forms the crotch of the panty is formed from synthetic material.

5. The panty of claim 1 wherein the crotch is made up of antimicrobial treated and non-treated yarn and wherein the antimicrobial treated yarn is interconnected through a knitted pattern and wherein the antimicrobial treated yarn is formed into the non-treated knitted yarn in a "laid-in" fashion.

6. The panty of claim 3 wherein the treated yarn comprises an acetate yarn and wherein the non-treated yarn comprises a synthetic yarn different than the acetate treated yarn.

7. The panty of claim 6 herein the acetate treated yarn is of a denier of approximately 50–150 and where in the non-treated yarn is a spun yarn of a 20–36 singles.

8. The panty of claim 7 wherein the panty crotch comprises a lightweight fabric of a weight of approximately 4–7 ounces per linear yard.

9. A panty having an antimicrobial treated crotch wherein the crotch is of an open knit construction and includes pretreated yarn spaced throughout with the pretreated yarn being subjected to a chlorinated antimicrobial treatment prior to knitting and wherein the antimicrobial treatment is aimed directly at killing and inhibiting the growth of yeast, bacteria and fungi wherein the crotch is made up of antimicrobial treated and non-treated yarn and wherein both the antimicrobial treated and non-treated yarn are knitted together to form a continuous knit construction made up of both treated and non-treated yarn.

10. A method of manufacturing a panty having a crotch fop killing and inhibiting the growth of yeast comprising the steps of: pretreating yarn with an antimicrobial chlorinated phenoxy compound prior to forming the yarn into a fabric wherein the antimicrobial treatment kills and inhibits the growth of yeast and bacteria; forming the pretreated yarn into an open knit fabric construction to form a panty crotch panel wherein the crotch panel is made up of antimicrobial treated and non-treated yarn and wherein both the antimicrobial treated and non-treated yarn are knitted together to form a continuous knit construction made up of both treated and non-treated yarn, and incorporating the pretreated panty crotch panel into a panty.

11. The method of claim 10 wherein the antimicrobial yarn comprises approximately 10 to 25% of the treated panty crotch.

12. The method of claim 10 wherein the treated yarn comprises an acetate yarn and wherein the non-treated yarn comprises a synthetic yarn different from the acetate treated yarn.

13. The method of claim 12 wherein the acetate treated yarn is of a denier of approximately 50–150 and wherein the non-treated yarn is of a spun yarn of a 20–36 singles.

14. The method of claim 13 wherein the panty crotch comprises a lightweight fabric of a weight of approximately 4–7 ounces per linear yard.

* * * * *